United States Patent [19]

Mumford

[11] 4,134,513

[45] Jan. 16, 1979

[54] CHILD-RESISTANT SAFETY CLOSURE

[75] Inventor: George V. Mumford, Toledo, Ohio

[73] Assignee: Owens-Illinois, Inc., Toledo, Ohio

[21] Appl. No.: 811,409

[22] Filed: Jun. 29, 1977

[51] Int. Cl.[2] ..... B65D 55/02; B65D 85/56; A61J 1/00

[52] U.S. Cl. ..... 215/216; 215/211; 215/214

[58] Field of Search ..... 215/211, 213, 216, 214

[56] References Cited

U.S. PATENT DOCUMENTS

| | | | |
|---|---|---|---|
| 3,888,373 | 6/1975 | Gach et al. | 215/214 |
| 3,941,268 | 3/1976 | Owens et al. | 215/216 |
| 4,004,704 | 1/1977 | Hilaire | 215/211 |

*Primary Examiner*—George T. Hall
*Attorney, Agent, or Firm*—Richard B. Dence; E. J. Holler

[57] ABSTRACT

A child-resistant, safety closure for a container having a dispensing end including a threaded neck portion onto which the closure is adapted to be threadably assembled. The closure includes an interiorly threaded sidewall having a flexible and resiliently distensible distal end portion provided with at least one interlocking member on its interior surface adapted to automatically interlockingly engage at least one complementary interlocking member on the dispensing end of the container when the closure is in either a fully closed or in at least one additional, partially removed position on the container neck portion. Removal of the closure, requires manual compression of the flexible distal end of the sidewall; applied at locations straddling the interlocking members, coupled with concurrent retrogressive movement of the closure, which ordinarily must be repeated at each interlocking position of the closure, and, therefore, requires both manual dexterity and knowledgeable intent beyond the capability of young children or other persons of comparable capabilities. Moreover, as a further safety factor, the interlocking members are inaccessibly and unobservably secluded within the interior confines of the closure when it is interlocked on the container.

17 Claims, 12 Drawing Figures

CHILD-RESISTANT SAFETY CLOSURE

The safety closure especially features a frictional, fluid-tight seal, such as plug seal or bead seal, between the safety closure and the neck portion of the container which intercooperates with the aforementioned safety features to prevent leakage of the container's contents even though the closure is partially removed from its fully closed position, or which is operative to prevent leakage of the container's contents at and between both the fully closed and the succeeding partially removed interlocking locations of the closure on the container end.

BACKGROUND OF THE INVENTION

1. Field of the Invention

The present invention pertains to a child-resistant, safety closure for packaging ingredients such as household chemicals, medicaments, or other ingredients, which may be dangerous and harmful to children and other persons of insufficient mental capacity to appropriately comprehend the threat of serious injury or death posed by contact with, or improper use of, such ingredients. Thus, the closure is of the type which is constructed in such manner that its removal from the container requires that a knowledgeable and purposeful thought process be employed in conjunction with a manual dexterity which is beyond the capabilties of an immature child or a person of similar mental faculties.

2. Description of the Prior Art

Heretofore, numerous versions of safety closures have been designed for the purpose of preventing children and other unknowledgeable persons from gaining access to dangerous household chemicals, medicaments and drugs such as are conventionally packaged in containers for consumer use. Among such types of safety closures are those which are of the non-reusable type associated with unit dose or single use containers. However, many types of dangerous and harmful household chemicals, medicines, and the like, characteristically are of the type which are packaged for frequent, repeated usage, or dispensation, and thereby require the employment of a safety closure which is susceptible to being frequently removed and reattached on the container, while at the same time retaining the features of being a child-resistant, safety closure. Among the latter types of safety closures which have attained substantial commercial acceptance are those which are frequently referred to as "squeeze-and-turn" types of safety closures. Various prior art types of patented squeeze-and-turn safety closures are described in, among others, U.S. Pat. Nos. 3,984,021 and 3,376,991 which require major modifications in the shape of the container neck portion in order to accommodate adequate deformation of the safety closure in response to manual compression, or squeezing to disengage it from the container.

Another version of a squeeze-and-turn safety closure designed for use with a container having a more conventionally styled circular neck portion is described in U.S. Pat. No. 3,941,268. While the last-mentioned patent provides a safety closure construction which features such advantages as being utilizable with a container having a more conventional type of neck portion and which also provides a highy desirable secondary interlock between the safety closure and the container neck portion, the seal between the closure and container may be impaired during use and permit leakage of the container's contents.

A serious problem existent with most of the known safety closures resides in the common use of a sealing liner positioned on the underside surface of the closure, and which is arranged to abut and seal against the annular rim on the container neck portion to prevent leakage of the container's contents. Customarily, most of the commonly employed sealing liners are fabricated in the form of thin discs of resilient plastic material which is sufficiently pliant to accommodate small imperfections in the rim surface of the container neck portion and provide a fluid-tight seal therewith. However, it is not uncommon for such plastic sealing materials to undergo plastic flow when compressed repetitively, or for prolonged periods of time, against the annular rim on the neck portion of the container. As a result, during the course of repeated removal and replacement of the closure in order to reach a fully closed position, the closure frequently must be further and further tightened to compensate for such liner deformation. As a result, the fully closed and sealed position of the closure gradually changes and causes a corresponding change in the rotational position of the closure relative to the container neck portion. However, since the relative rotational orientation of the interlocking members provided on the container and the safety closure remains unchanged, the fully closed and sealed position of the closure no longer orientationally corresponds to the original interlocking, fully closed position. Thus, leakage of the container's contents is apt to occur in the event that the safety closure is loosened or otherwise returned to its original fully closed and interlocked location on the neck portion of the container. Consequently, although the safety closure may be positioned in its original fully closed position in interlocked engagement with the container, the sealing liner may have been rendered ineffective to prevent leakage of the container's contents. Thus, a child while handling the container may come into harmful or injurious contact with the contents leaking from the container.

Also, many of the patented prior art types of squeeze-and-turn safety closures employ readily observable, exposed tabs and complementary detents on the closure and container for purposes of preventing closure removal. Indicative of patents employing such exposed tabs are previously mentioned in U.S. Pat. No. 3,984,021 and such other representative patents as U.S. Pat. Nos. 3,770,153; 3,826,395; 3,830,391 and 3,841,514. Among other possibilities, the repeated flexing or stressing of such tabs renders them susceptible to being weakened in consequence of stress damage, and thus apt to failure when subjected to even minimal force such as might be exerted by a child attempting to remove the closure. No less importantly, the exposed and observable presence of such tabs makes them more susceptible to being disengaged from the container by an inquisitive child.

SUMMARY OF THE INVENTION

In accordance with the present invention, a child-resistant, safety closure is provided for assemblement with a container in such manner as to preclude a child, or a person of comparable mental capability, from either removing the closure or becoming exposed to the container's contents. The safety closure features the advantages of having a sidewall with one interior surface portion threadably engageable with the threaded neck portion of the container and another resiliently deformable, or distensible, distal end portion provided on its interior surface with interlocking members designed to interlockingly engage the dispensing end of the container, both when the safety closure is in a fully closed and sealed position and when the safety closure is positioned in at least one partially removed location on the threaded neck portion of the container. The resiliently deformable, or distensible, construction of the distal end of the sidewall is such that manual compression thereof, at locations straddling the interlocking members, coupled with concurrent retrogressive rotation of the closure will permit disengagement of the interlocking members and permit partial removal of the closure to the next interlocking location where such manual compression and retrogressive movement must ordinarily be repeated to further remove the closure.

Of added significance, the interlocking members are structured and designed in such manner that they are arranged to interlock within the interior confines of the closure and thus be secluded and rendered inaccessible and unobservable when the closure is assembled on the container.

In combination with the foregoing features, the safety closure of the present invention is suitably designed to also be adapted to provide a fluid-tight, seal which is capable of maintaining fluid-tight sealing contact with the container neck portion even though a conventionally provided sealing liner becomes ineffective to prevent leakage of the container's contents, or even when the safety closure is partially removed through retrogressive threaded rotation from its fully closed position to the next succeeding interlocking location.

Keeping the foregoing features in mind, it is a principal objective of the present invention to provide an improved child-resistant, safety closure which in order to be removed from the container necessitates knowledgeable intent beyond the capabilities of an immature child or person of like mentality.

Another objective of the present invention is the provision of a child-resistant, safety closure having interlocking means which defy its removal from a container by a child and which is characterized by having the interlocking means disposed in a location which is both inaccessible and unobservable when the closure is assembled on a container.

An additional objective of the present invention is the provision of a child-resistant, safety closure which is structured in such manner that it will interlockingly engage the dispensing end of the container both in its fully closed and sealed position on the container neck portion and also interlockingly engage the dispensing end of the container in another partially removed location on the container neck portion, to thereby provide additional protection and precaution against accidental removal by a child or comparable immature person.

A further objective of the present invention is the provision of a safety closure which in addition to possessing the characteristics of the last-mentioned objective is also capable of maintaining fluid-tight sealed relationship with the dispensing end of the container, both when located in either its fully closed position or when located in a partially removed secondary interlocking location on the container neck portion.

The specific nature of the present invention, as well as other objects and advantages thereof, will become readily apparent to those ordinarily skilled in the art from the following detailed description taken in conjunction with the annexed drawings wherein, by way of example only, certain preferred embodiments of the present invention are illustrated.

DETAILED DESCRIPTION OF THE PREFERRED EMBODIMENTS OF THE INVENTION

Figure 1:
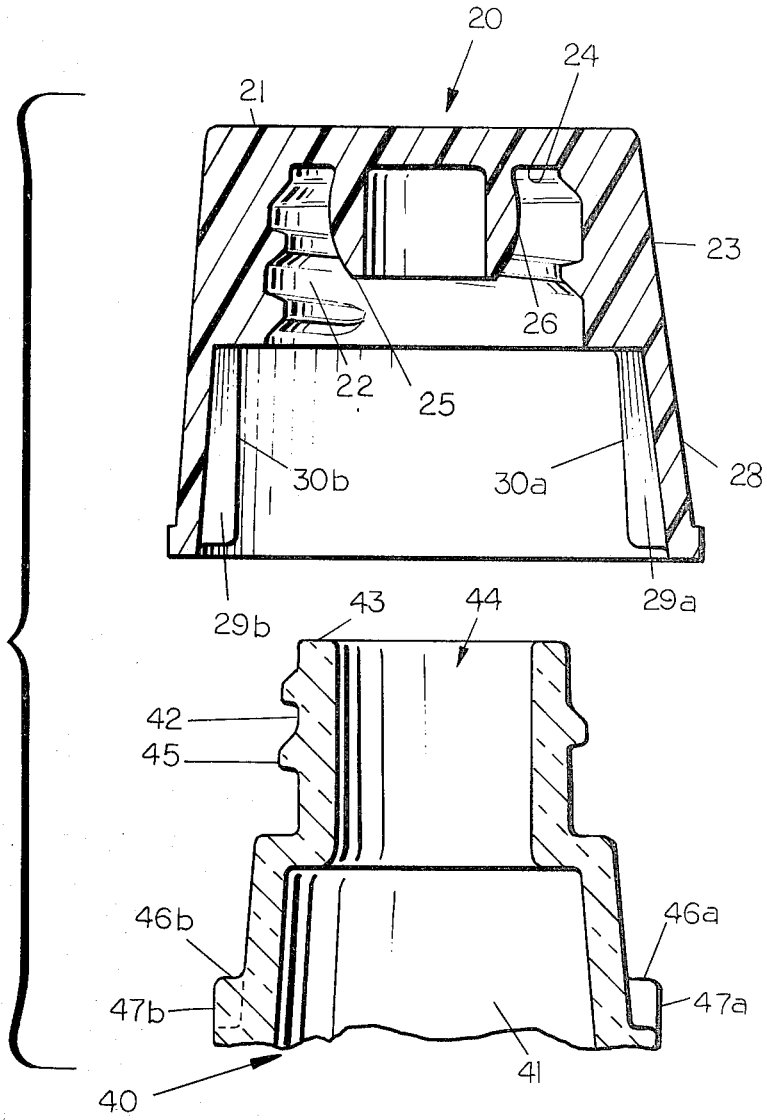
FIG. 1 is an exploded, elevational view in central section of the dispensing end of a container and a child-resistant, safety closure embodying one preferred version of the present invention.

In accordance with one preferred embodiment of the present invention exemplified in FIG. 1, a safety closure 20 is illustrated in disassembled overlying relationship with a container generally designated as 40 and only the dispensing end 41 of which is shown. The closure 20 is designed to be threadably assembled on the dispensing end 41 and threadably advanced to a fully closed position depicted in FIG. 2. When thus assembled, the safety closure 20 is designed to interlock with the dispensing end 41 of the container 40 and resist retrogressive threaded movements necessary for normal threaded removal of the closure from the container.

As illustrated, the safety closure 20, which is preferably fabricated from a resilient plastic, such as polyvinyl chloride, polypropylene, or similar-resilient or pliant material, defines a frusto-conical, generally cup-shaped overall configuration and includes a closed endwall 21 carrying a depending, integral, annular sidewall 23. Disposed concentrically within and interspaced from the sidewall 23, there is a resilient, tubular, sealing plug 25 which depends integrally from the underside surface 24 of the sidewall 21. As shown, the sealing plug 25 is preferably provided with outer peripheral surface portion defining a radially enlarged and convexly rounded, peripheral sealing segment 26. As will subsequently be described in greater detail, the sealing plug 25 is adapted to firmly seal the dispensing end 41 of the container 40 in fluid-tight sealed relationship when the closure 20 is assembled on the container in the fully closed position shown in FIG. 2.

Provision for threadable engagement of the closure 20 on the dispensing end 41 of the container is afforded by the sidewall 23 which has a proximal, or first sidewall, section defining a threaded section 22 on its interiorly facing surface and which has an axially opposite distal, or second sidewall, section 28 of generally circular cross-sectional configuration, adapted to cooperatively interlock with the dispensing end 41 of the container in at least two separate threadably assembled positions to be subsequently described.

The means for interlocking the distal end portion 28 of the sidewall 23 with the dispensing end 41 of the container 40 is provided in the form of a pair of diametrically opposite and axially extending locking ribs **29*a* and 29*b* integrally formed on the interiorly facing surface of the sidewall and which project radially inward to define narrow interiorly facing surfaces 30*a* and 30*b*, respectively. Also, as shown, the locking ribs 29*a* and 29*b* extend essentially the entire interior length of the distal end portion 28 of the sidewall and each has a terminal end terminating at a location proximately recessed within the interior confines of the distal end portion 28 of the sidewall 23. Thus, the locking ribs 29*a* and 29*b*** are secluded within the closure, and when the closure is assembled on the dispensing end of the container, the locking ribs are inaccessible and unobservable.

With regard to the container 40, the dispensing end 41 thereof includes an exteriorly threaded neck portion 42 terminating in an annular rim 43 which, in turn, defines a dispensing opening, at 44, communicating with the interior confines of the container. The threaded neck portion 42 is conventionally designed for complementary threaded engagement with the threaded section 22 of the sidewall 23 and is located axially between the annular rim 43 and interlocking means integrally formed on the exterior surface of the container dispensing end 41.

In more particular respects, the interlocking means on the dispensing end 41 of the container 40 includes a pair of diametrically opposite, peripherally extending shoulder segments **46*a* and 46*b*, each of which respectively defines an eccentric peripherally tapered, or inclined, edge surface which functions as a camming surface 47*a*, 47*b*. As illustrated, each of the camming surfaces is inclined, or peripherally enlarges, in the direction of the path of threaded attachment, or advancement, of the closure 20 onto the dispensing end 41 of the container 40, and, as best observed in FIGS. 3–5, terminates abruptly in a radial ledge, such as 48*a* and 48*b*, which forms an abutment projecting radially from the dispensing end of the container to the inclined end of each of the camming surfaces 47*a* and 47*b*. The radial ledges 48*a* and 48*b* are strategically located at diametrically opposite peripheral locations, i.e. 180° apart, on the dispensing end 41 and are orientationally arranged to respectively abut against one each of the closure locking ribs 29*a* and 29*b* when the closure is threadably advanced to a fully closed position, such as is indicated in FIGS. 2 and 3, and in which position the resilient sealing plug 25 is adapted to fit snugly within the dispensing opening 44 with the peripheral sealing segment in frictional, fluid-tight, continuous sealing contact with the interior surface of the container neck portion 42**.

Figure 2:
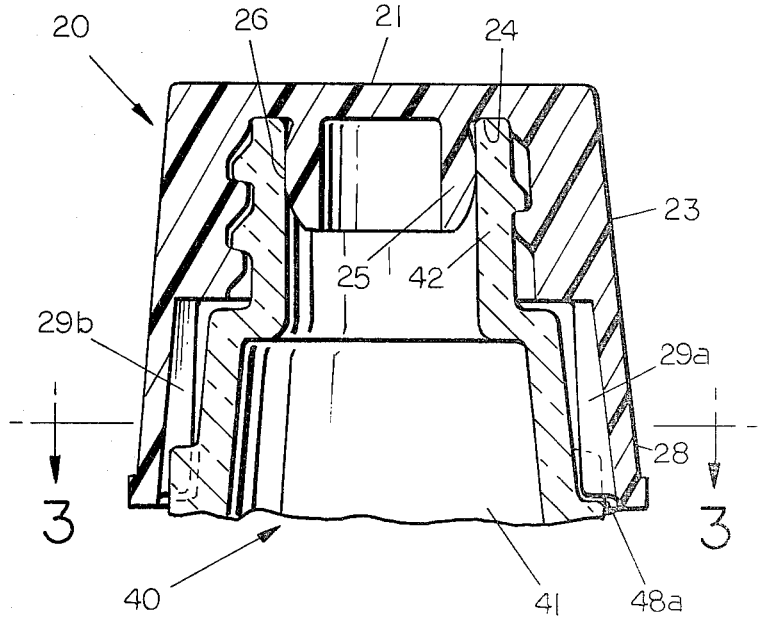
FIG. 2 is an elevational view in central section of the safety closure and the dispensing end of the container depicted in FIG. 1, but showing the safety closure in fully closed and interlocked child-resistant engagement with the dispensing end of the container.

By virtue of the particular construction described above, during the course of threaded attachment, or advancement, of the safety closure 20 on the container dispensing end 41, the sealing plug 25 is gradually forced into the dispensing opening at 44 and the locking ribs **29*a* and 29*b* will, prior to reaching the fully closed position, shown in FIG. 2, individually contact the inclined camming surfaces 47*a* and 47*b*. Thereafter, further threaded advancement of the closure will cause the locking ribs 29*a* and 29*b* to flex radially outward as they ride on the gradually inclined camming surfaces 47*a* and 47*b* and thereby deform, or distend, the resiliently flexible distal end portion 28 of the closure outer sidewall 23 sufficiently to accommodate continued manual threaded advancement of the closure to the fully closed position shown in FIG. 2 in which, as previously described, the peripheral sealing segment 26 on the sealing plug 25 is snugly pressed into fluid-tight, continuous, sealing contact with the interior wall surface of the neck portion 42. As illustrated, the radial ledges 48*a* and 48*b* are disposed to orientationally correspond to the fully closed position of the closure 20** and to provide an abutment blocking each of the locking ribs and resisting attempted reverse, or retrogressive, threaded movement necessary for removal of the closure. Thus, normal threaded removal of the safety closure, such as might be attempted by an unknowledgeable child, is precluded. However, as will hereinafter be described, removal of the safety closure by a mature or knowledgeable person may be accomplished in a relatively facile manner.

Figure 3:
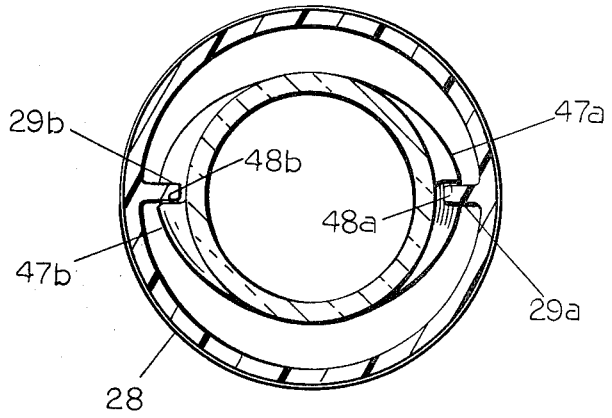
FIG. 3 is a sectional view taken along and in the direction of sectional plane 3—3 in FIG. 2.
Figure 4:
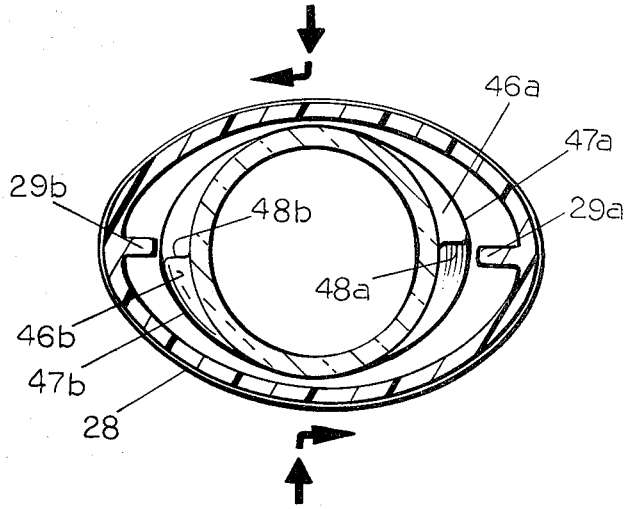
FIG. 4 is a sectional view similar to that depicted in FIG. 3, but depicting certain functional characteristics of the invention by showing the distorted elliptical cross-sectional configuration of the sidewall of the safety closure relative to the dispensing end of the container resulting from manually compressing opposite sides of the safety closure to disengage the closure from interlocking engagement with the container.
Figure 5:
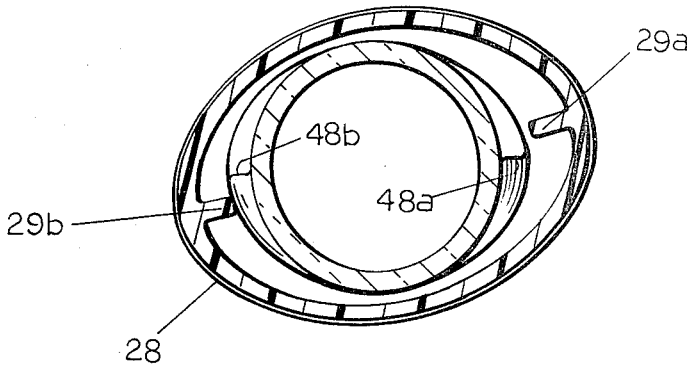
FIG. 5 is another sectional view similar to FIG. 3, but further showing the distorted closure removably, or retrogressively, rotated a fractional revolution subsequent to disengagement of the child-resistant interlock.

As best depicted in FIGS. 3–5, to accomplish threaded removal of the closure 20, the locking ribs **29*a* and 29*b* must first be disengaged from interlocking engagement, or abutment, with the radial ledges 48*a* and 48*b*. Such disengagement from the interlocking engagement depicted in FIG. 3 may be readily accomplished by manually compressing the resiliently deformable, distal end portion 28 of the sidewall 23 at peripheral locations straddling the locations of interlocking engagement to thereby deform, or distend, the sidewall 23 from its normal generally circular cross-sectional configuration, shown in FIG. 3, to a generally elliptical cross-sectional configuration depicted in FIG. 4. Such manual compression coupled with concurrently applied retrogressive rotation of the closure 20 (indicated by directional arrows in FIG. 4) permits the locking ribs 29***a* and 29*b* to override the radial ledges 48*a* and 48*b*, as depicted in FIG. 5, and allow further retrogressive rotation of the closure.

Figure 6:
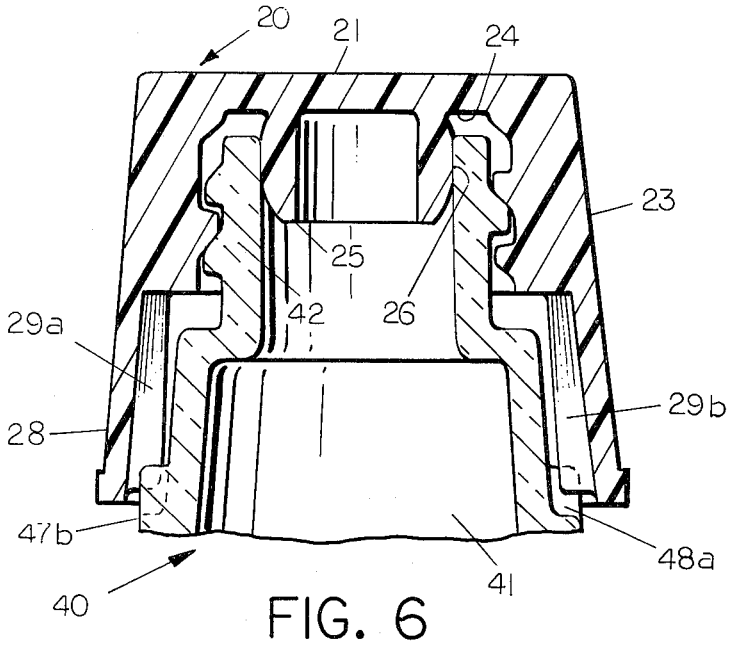
FIG. 6 is a centrally sectioned, elevational view of the embodiment depicted in FIG. 2, but, for purposes of showing the multiple interlock aspects of the child-resistant closure with the container, illustrating the interlocking positions of the closure and the container when the closure has been removably, or retrogressively, rotated through 180°, or one-half threaded revolution relative to the container neck.

Preferably, the axial height, or extent, of the camming surfaces 47*a* and 47*b*, and their respective radial ledges 48*a* and 48*b*, is such that they will again, as shown in FIG. 6, intercept the locking ribs 29*a* and 29*b* when the closure 20 has been retrogressively rotated one-half threaded turn, or 180°, from its fully closed position. Upon arrival at the position shown in FIG. 6, the locking ribs 29*a* and 29*b* and the radial ledges 48*a* and 48*b* will again be in position to intercept each other and block further normal threaded removal of the closure 20. Although it is possible to maintain continued manual compression and concurrent retrogressive rotation of the closure sufficiently to rotate the closure in excess of 180° to avoid a secondary interlocking, as shown in FIG. 6, the necessary manual dexterity required is quite difficult even for a person possessing knowledge of the operational characteristics of the interlocking members, and more importantly is beyond the ordinary capabilities of an immature child. Otherwise stated once the closure 20 has been retrogressively shifted to the position indicated in FIG. 5, manual compression will ordinarily be released in favor of a succession of normal twisting movements; each of which is customarily much less than 180° in extent. Thus, a second interlocking engagement between the closure and container will ordinarily result and will require a repetition of the compressive and turning movements described with respect to FIGS. 3–5. Keeping the foregoing in mind, it is exceedingly unlikely that an immature child would possess the requisite comprehension to premediatively apply the necessary repetitious manual compression and concurrent retrogressive rotation, particularly at peripheral locations straddling the interlocking locations, necessary to remove the closure from the container. In other words, although an immature child possibly might accidentally disengage the closure from its initial fully closed and interlocked position on the dispensing end of the container, the liklihood of repetition of such accidental disengagement from the next sequential interlocking location, removed 180° from the fully closed position, is extremely remote.

With further regard to possible accidental disengagement of the closure 20 from its fully closed and interlocked position, it is important in such event that the contents of the container are prevented from leaking out and posing a potential threat of harm or injury to a child. To this end, the sealing plug 25 is preferably of sufficient axial extent, or length, to ensure continuous fluid-tight sealing contact with the interior surface of the container neck portion 42 even when the closure 20 is threadably displaced from the fully closed and interlocked position shown in FIG. 2 and retrogressively rotated to a succeeding interlocked position, such as, for example, the position shown in FIG. 6, wherein it will be seen that the sealing plug 25 still maintains a continuous fluid-tight sealing contact with the interior surface of the neck portion 42.

While the foregoing embodiment has been shown and described as having only two sealed, sequential interlocking locations corresponding to the fully closed position of the closure 20 on the dispensing end 41 of the container 40 and a position in which the closure has been retrogressively rotated 180°, it will be readily apparent that, if desired, additional sequential interlocking locations may be provided by longitudinally extending the radial ledges 48*a* and 48*b* sufficiently to intercept the locking ribs 29*a* and 29*b* at additional locations during removal of the closure. Likewise, the sealing plug and container neck portion may be lengthened, as desired, to afford a still greater extent of continuous, axial sealing surface between the sealing plug and the interior surface of the neck portion. In any event, repeated and premeditatively applied manual compression of the distal end 28 of the sidewall 23 of the closure 20 coupled with retrogressive rotation of the closure will permit the closure to be rotated to a position whereafter the closure may be threadably removed in conventional, non-compressed, manner.

Figure 7:
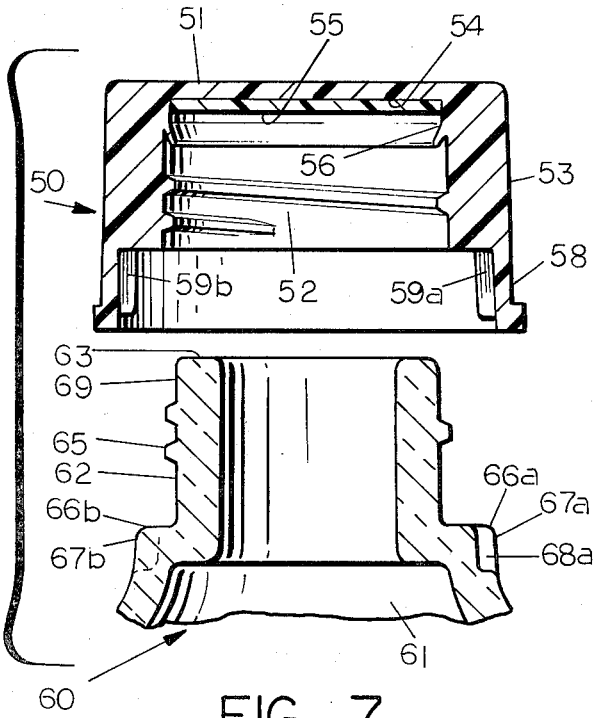
FIG. 7 is an exploded, centrally sectioned, elevational view of the dispensing end of a container with still another alternative version of the child-resistant, safety closure of the present invention with a fractionally slidable seal provided between the safety closure and the dispensing end of the container.
Figure 8:
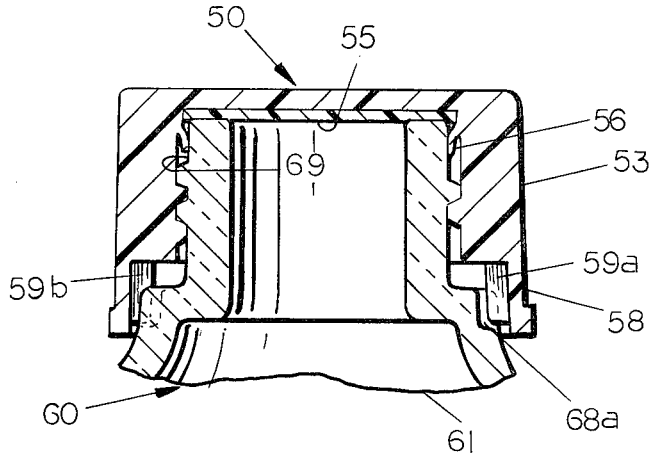
FIG. 8 is a centrally sectioned elevational view of the version of the invention shown in FIG. 7, but illustrating the functional aspects of the frictional seal between the closure and the container neck when the closure is positioned in fully closed and child-resistant, interlocking engagement with the dispensing end of the container.
Figure 9:
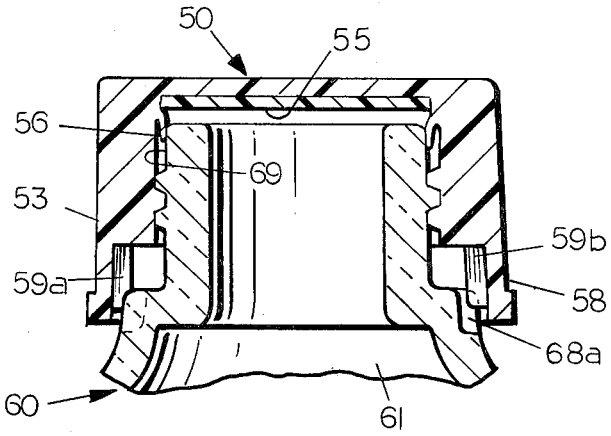
FIG. 9 is a view similar to FIG. 8, but further illustrating the functional aspects of the frictional seal and sequential interlock when the closure has been removably rotated 180° from the fully closed interlocked position depicted in FIG. 8.

Another alternative embodiment of the invention is shown in FIGS. 7–9, wherein a child-resistant, safety closure incorporating a plural interlock (viz. shoulder segments 66*a* and 66*b*, camming surfaces 67*a* and 67*b* and radial ledges such as 68*a*) features another form of frictionally slidable seal between the safety closure and the neck portion of the container. As illustrated, the container 60 includes a dispensing end 61 provided with a neck portion 62 having a smooth, axially extended exterior neck finish defining a peripheral secondary sealing surface 69 disposed between an annular rim 63 and exterior threads 65. As shown, the safety closure 50 may, if desired, include a resilient, fluid-impermeable sealing liner 55 provided on the underside surface 54 of the closed endwall 51 and which is arranged to seat upon the annular rim 63 of the container in fluid-tight sealed relationship when the safety closure 50 is in fully closed position (FIG. 8) with locking ribs 59*a* and 59*b* interlocked with the radial ledges, such as radial ledge 68*a* and its diametrically opposite counterpart, on the dispensing end of the container. Additionally, however, the closure 50 includes a continuous annular sealing bead 56 of flexible and resilient material formed integrally on the interior surface of the sidewall 53 at a location intermediate the threaded interior portion and the sealing liner 55. In the form shown in FIGS. 7–9, the sealing bead 56 slopes convergently inwardly and axially away from the closed endwall 51 of the closure to define an innermost end portion of circular configuration bordering a central opening of slightly smaller diameter than the secondary sealing surface 69 on the container neck portion 62. As thus constructed, the innermost end portion of the sealing bead 56 will resiliently flex against and snugly contact the secondary sealing surface 69 in peripheral, fluid-tight sealed relationship and thereby provide a secondary seal as a backup to the sealing liner 55 when the safety closure 50 is assembled, as illustrated in FIG. 8, in fully closed position on the dispensing end 61 of the container 60. Moreover, the secondary sealing surface 69 is of sufficient axial extent to maintain continuous fluid-tight, frictional, sealing contact with the sealing bead 56 when the closure is threadably displaced a substantial distance away from the fully closed position. Preferably, as shown in FIG. 9, the axial extent of the secondary sealing surface 69 is sufficient to maintain continuous sealing contact with the sealing bead 56 throughout threaded retrogressive movement, or removal, of the safety closure 50 and locking ribs 59*a* and 59*b* to the next succeeding interlocking location with the dispensing end 61 of the container 60; the next succeeding interlocking location being illustrated in FIG. 9 as one-half threaded revolution, or 180°, removed from the fully closed position.

Figure 10:
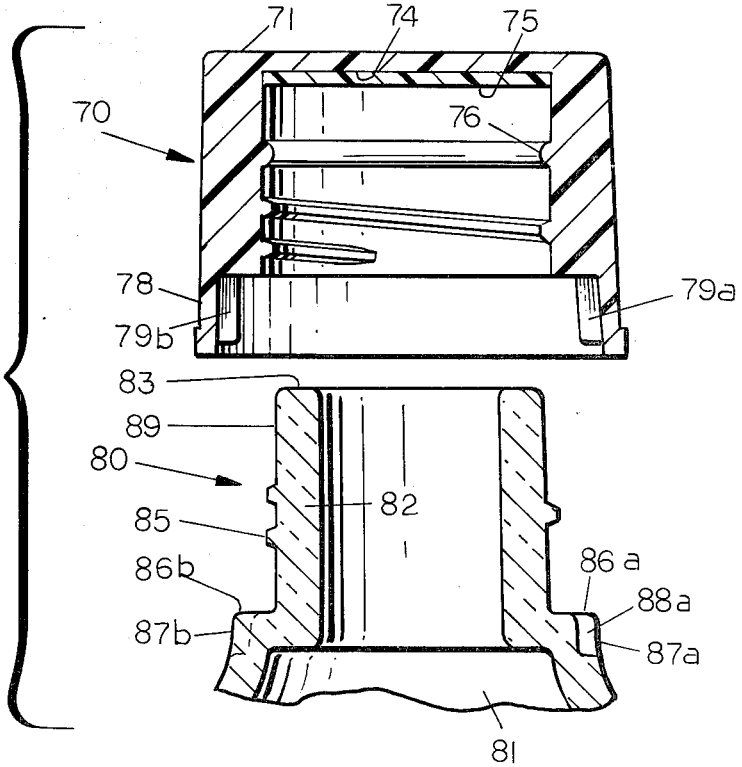
FIG. 10 is an exploded, centrally sectioned, elevational view of yet another alternative version of the present invention in which another form of frictional seal is provided between the safety closure and the dispensing end of the container.
Figure 11:
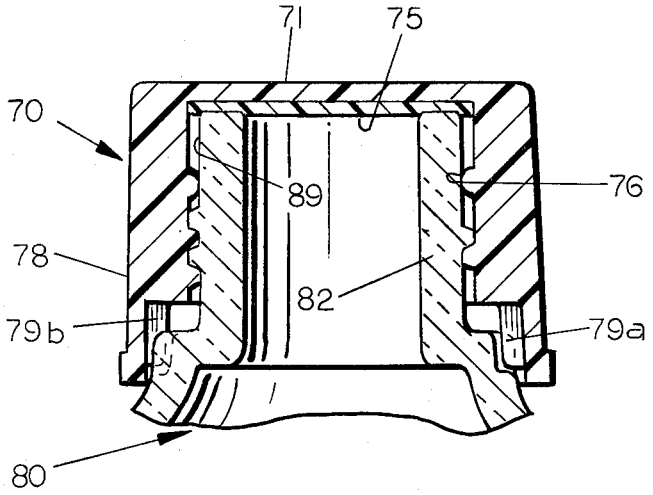
FIG. 11 is a centrally sectioned, elevational view of the safety closure and container depicted in FIG. 10, but illustrating the closure assembled in fully closed and child-resistant interlocking engagement with the dispensing end of the container.
Figure 12:
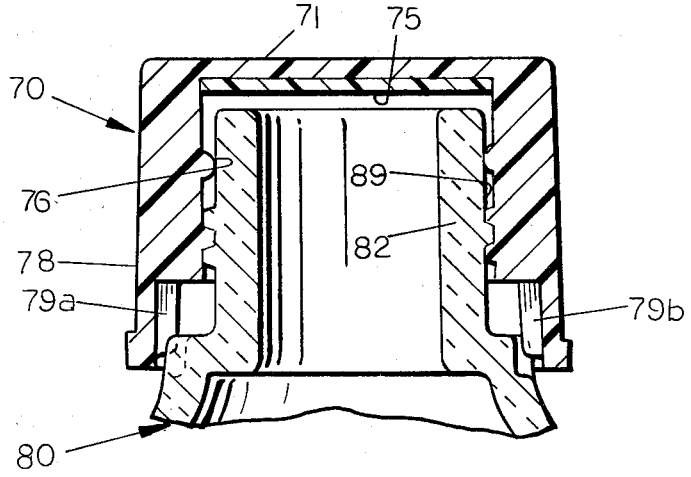
FIG. 12 is a view similar to FIG. 11, but illustrating the sequential interlocking and concurrent retention of the sealed relationship between the safety closure and container when the closure has been rotatably removed 180° relative to the fully closed position thereof on the container neck portion.

By way of contrast with the embodiment of the invention depicted in FIGS. 7–9, another form of peripheral sealing bead 76 of resilient material is illustrated in FIGS. 10–12 as being integrally formed on the interior surface of the sidewall 73 of the safety closure 70. As shown, the sealing bead 76 defines a hemispherical cross-sectional configuration and, as in the previously described embodiment, is disposed between the sidewall threads 77 and the sealing liner 75 on the underside surface 74 of the closed endwall 71 of the closure. Again, as with the previous embodiment, the dispensing end 81 of the container is shown with diametrically opposite shoulder segments 86*a* and 86*b* defining camming surfaces 87*a* and 87*b* and radial ledges such as the one indicated at 88*a*. Also, as in the preceding embodiment, the neck portion 82 of the container 80 is provided with a smooth, axially elongated, exterior finish which defines a secondary peripheral sealing surface 89 disposed between the annular sealing rim 83 and the neck threads 85. The peripheral sealing surface 89, which is slightly larger in diameter than the interior surface of the sealing bead 76, will thus contact the sealing bead 76 in snug, fluid-tight, frictional sealing contact when the safety closure 70 is threadably advanced to the fully closed position on the dispensing end 81 of the container, as shown in FIG. 11, as well as when the safety closure is threadably rotated to a succeeding interlocking position, as depicted in FIG. 12, in which the safety closure and locking ribs 79*a* and 79*b* have been removably rotated through 180° or one-half threaded revolution.

Thus, in each of the three separate embodiments described, an axially slidable fluid-tight seal is maintained between the child-resistant, safety closure and the dispensing end of the container even though the safety closure becomes substantially displaced from the fully closed and interlocked position. Also, in each instance, the maintenance of this fluid-tight sealed relationship is effective to preclude leakage of the container's contents from within the protective confines of the safety closure while the safety closure is retained in child-resistant, interlocked engagement with the dispensing end of the container. Consequently, effective assurance is provided that there is little, if any, liklihood of escape of the container's contents or resultant accessibility thereof to a young child.

Although the present invention has been illustrated and described in a preferred embodiment empolying a closure having a pair of diametrically opposite locking ribs and a complementary pair of camming surfaces, or radial ledges, it will be readily apparent that one such locking rib together with one or more camming surfaces would also be effective and possibly be desirable in certain instances without detracting from the basic features of the present invention. Moreover, it will be clearly apparent that the interlocking members may be reversed in such manner that the camming surface, or surfaces, with their accompanying radial ledge, or ledges, are provided on the interior surface of the outer-sidewall of the closure, and correspondingly the locking rib, or ribs, are provided on the exterior surface of the dispensing end of the container.

Also, although the closure has been shown and described with respect to FIGS. 7–9 and 10–12 as preferably employing a sealing liner, it will be understood that a sealing liner may, if desired, be omitted in favor of a resilient linerless closure.

It will, of course, be understood that various details of construction, combination and assembly may be modified throughout a range of equivalents, and it is, therefore, not the purpose to limit the scope of the present invention otherwise than as necessitated by the scope of the appended claims.

I claim:

1. In a child-resistant safety closure adapted for threadable attachment on a container having a generally cylindrical hollow dispensing end including an exteriorly threaded neck portion and defining a smooth axially extending peripherally continuous exterior sealing surface disposed between the threaded portion and an annular rim defining a dispensing opening, and an interlocking member orientationally arranged to interlock said closure on said dispensing end when said closure is threadably advanced to a fully closed position on said neck portion, said closure comprising:

a closed endwall, an integral depending first sidewall section and second sidewall section projecting axially beyond said first sidewall section, said first sidewall section defining a threaded interior surface portion threadably engageable with the threaded neck portion of said container to accommodate threaded advancement of said closure on said neck portion to a fully closed position, said second sidewall section having a generally circular cross-sectional configuration and being sufficiently flexible to deform from said generally circular cross-sectional configuration to a generally elliptical cross-sectional configuration in response to manual compression of diametrically opposite sides thereof and being sufficiently resilient to essentially resume said generally circular cross-sectional configuration promptly upon release of said manual compression;

an interlocking member integrally formed on said second sidewall section and adapted to override interlocking engagement with the interlocking member on said container in response to normal threaded advancement of said closure on said neck portion, but to intercept the latter interlocking member in interlocking engagement in response to normal threaded retrogressive movement of said closure on said neck portion, and said interlocking engagement being releasable in response to manual compression and concurrent threaded retrogressive movement applied to said sidewall of said closure;

the improvement wherein said first sidewall section of said closure includes a continuous annular sealing bead of flexible and resilient material projecting radially inwardly from the interior surface of said first sidewall section between said closed endwall and said threaded interior surface portion, said sealing bead being adapted to contact said exterior sealing surface on said neck portion in fluid-tight sealing relationship when said closure is in said fully closed position and to maintain continuous fluid-tight frictionally slidable sealing relationship therewith when said closure is threadably rotated to a location substantially displaced from said fully closed position.

2. In a child-resistant safety closure and container combination comprising:

a container having a generally cylindrical hollow dispensing end including an exteriorly threaded neck portion and an annular rim defining a dispensing opening;

a closure for said container having a closed endwall, an integral depending annular first sidewall section and second sidewall section projecting axially beyond said first sidewall section, said first sidewall section defining a threaded interior surface portion threadably engageable with the threaded neck portion of said container to accommodate threaded advancement of said closure on said neck portion to a fully closed position, said second sidewall section having a generally cylindrical distal end portion sufficiently flexible to deform from a generally circular configuration to a generally elliptical configuration in response to manual compression of diametrically opposite sides thereof and being sufficiently resilient to essentially resume said generally cylindrical configuration promptly upon release of said manual compression;

cooperative interlocking means including interlocking members integrally formed respectively on said second sidewall section and on the dispensing end of said container, said interlocking members being arranged to override interlocking engagement with each other in response to normal threaded advancement of said closure on said neck portion and in response to normal threaded retrogressive movement of said closure on said neck portion to intercept each other in interlocking engagement at sequential interlocking locations orientationally related respectively to at least two separate threadably engaged positions of said closure on said neck portion, one of said interlocking locations being arranged to correspond to said fully closed position of said closure and another of said interlocking locations being disposed to substantially precede arrival of said closure in said fully closed position, said interlocking engagement at each of said interlocking locations being releasable in response to manual compression and concurrent threaded retrogressive movement applied to said second sidewall section at peripheral locations straddling said interlocking engagement and which manual compression coupled with concurrent threaded retrogressive movement customarily must be repetitiously and premeditatively applied to said sidewall of said closure at peripheral locations straddling each of said interlocking locations in order to threadably remove said closure from said neck portion;

the improvement wherein said container neck portion defines an axially extending peripheral sealing surface, and said closure includes interior sealing means adapted to contact said sealing surface in fluid-tight sealing relationship when said closure is in said closed position and to continuously maintain frictionally slidable fluid-tight relationship therewith while said closure is threadably rotated to the other of said interlocking locations.

3. In a child resistant safety closure as defined in claim 1, wherein said sidewall section is an integral longitudinal continuation of said first sidewall section.

4. In a child-resistant safety closure as defined in claim 2, wherein said second sidewall section is an integral longitudinal continuation of said first sidewall section.

5. In a child-resistant safety closure as defined in claim 1, wherein said interlocking member on said second sidewall section is also adapted to override interlocking engagement with said interlocking member on said container in at least one other interlocking location in response to normal threaded advancement of said closure on said neck portion, but to intercept said interlocking member on said container in interlocking engagement at said other interlocking location in response to normal threaded retrogressive movement of said closure on said neck portion, said other interlocking location being arranged to substantially precede arrival of said closure in said fully closed position, said interlocking engagement at said other interlocking location also being releasable in response to manual compression and concurrent threaded retrogressive movement applied to said sidewall of said closure at said other interlocking location, whereby manual compression coupled with concurrent threaded retrogressive movement customarily must be repetitiously and premeditatively applied to said sidewall of said closure at both said fully closed and said other interlocking locations in order to threadably remove said closure from the neck portion of said container, and wherein said sealing bead is adapted to contact and to continuously maintain said fluid-tight frictionally slidable sealing relationship with said exterior sealing surface on said neck portion while said closure is being threadably rotated between said fully closed position and said other interlocking location.

6. In a child-resistant safety closure as defined in claim 1, wherein said sealing bead defines a generally hemispherical cross-sectional configuration.

7. In a child-resistant safety closure as defined in claim 1, wherein said sealing bead is inclined radially inwardly and away from said endwall.

8. In a child-resistant safety closure and container combination as defined in claim 2, wherein said peripheral sealing surface is located on the interior peripheral surface of said neck portion.

9. In a child-resistant safety closure and container combination as defined in claim 8, wherein said interior sealing means on said closure comprises a plug member depending axially from the underside surface of the endwall of said closure, said plug member having an outer peripheral surface portion snugly insertable within said dispensing opening and adapted to contact said peripheral sealing surface in frictionally slidable fluid-tight sealing relationship.

10. In a child-resistant safety closure and container combination as defined in claim 2, wherein said peripheral sealing surface is located on the exterior peripheral surface of said neck portion and comprises a smooth axially extending peripherally continuous sealing surface disposed between the exteriorly threaded portion and the annular rim of said neck portion.

11. In a child-resistant safety closure and container combination as defined in claim 10, wherein said interior sealing means on said closure comprises an annular inwardly projecting sealing bead adapted to snugly contact said peripheral sealing surface in frictionally slidable fluid-tight sealed relationship.

12. In a child-resistant safety closure and container combination as defined in claim 11, wherein said sealing bead is disposed between said threaded interior portion of said first sidewall section and said closed endwall.

13. In a child-resistant safety closure and container combination as defined in claim 11, wherein said sealing bead defines a generally hemispherical cross-sectional configuration.

14. In a child-resistant safety closure and container combination as defined in claim 11, wherein said sealing bead is inclined radially inwardly and away from said endwall.

15. In a child-resistant safety closure and container combination as defined in claim 2, wherein said interior sealing means of said closure comprises an axially depending central plug on the underside surface of said closed endwall and having an outer peripheral surface portion snugly insertable within said dispensing opening and providing continuous peripheral fluid-tight sealing contact with the interior wall surface of said neck portion when said closure is in said fully closed position, and said plug being of sufficient axial extent to maintain said fluid-tight sealing contact when said closure is threadably rotated to the other of said interlocking locations.

16. In a child-resistant safety closure and container combination as defined in claim 2, wherein the closed endwall of said closure is provided with sealing means on the underside thereof arranged to seal said dispensing opening when said closure is threadably advanced to said fully closed position, and wherein said axially extending peripheral sealing surface defined on the neck portion of said container is disposed on the exterior surface of said neck portion and between the annular rim and the threaded portion thereof, and wherein said interior sealing means of said closure comprises an annular inwardly projecting sealing bead of flexible and resilient material disposed to seat against said peripheral sealing surface on said container neck portion in continuous fluid-tight frictional sealing contact when said closure is in or threadably rotated between said interlocking locations.

17. In a child-resistant safety closure as defined in claim 5, wherein said other interlocking location is disposed about one-half threaded revolution preceding arrival of said closure in said fully closed position.

* * * * *